US008157466B2

(12) United States Patent
Mueller et al.

(10) Patent No.: US 8,157,466 B2
(45) Date of Patent: Apr. 17, 2012

(54) CLEANING DEVICE

(75) Inventors: John Mueller, Wauwatosa, WI (US); Patricia Mueller, Wauwatosa, WI (US); Garrett Butrym, Milwaukee, WI (US)

(73) Assignee: Idea Factory, Inc., Menomonee Falls, WI (US)

( * ) Notice: Subject to any disclaimer, the term of this patent is extended or adjusted under 35 U.S.C. 154(b) by 511 days.

(21) Appl. No.: 12/280,582

(22) PCT Filed: Mar. 7, 2006

(86) PCT No.: PCT/US2006/008265

§ 371 (c)(1), (2), (4) Date: Aug. 25, 2008

(87) PCT Pub. No.: WO2007/102820

PCT Pub. Date: Sep. 13, 2007

(65) Prior Publication Data

US 2009/0032074 A1 Feb. 5, 2009

(51) Int. Cl.
*A47L 1/08* (2006.01)

(52) U.S. Cl. ..... 401/136; 401/139; 401/289

(58) Field of Classification Search ..... 401/136, 401/137, 139, 289
See application file for complete search history.

(56) References Cited

U.S. PATENT DOCUMENTS 3,377,123 A * 4/1968 Leeson ..... 401/139

* cited by examiner

*Primary Examiner* — Christopher Kim
(74) *Attorney, Agent, or Firm* — Joseph S. Heino; Patrick M. Bergin

(57) ABSTRACT

A cleaning device having a handle, the handle having a cleaning pad assembly capable of pivoting between a cleaning position and a rinsing position. The handle of the cleaning device may further comprise a conduit for directing the flow of a liquid from a liquid input to a liquid output, the liquid output being capable of direction either though the cleaning pad to wet the cleaning pad or at a surface to rinse a surface. The cleaning device may further comprise a valve, the valve being operable to control the flow of water through the handle.

9 Claims, 7 Drawing Sheets

CLEANING DEVICE

FIELD OF THE INVENTION

The present application relates generally to cleaning devices. More particularly, it relates to an improved hand-held cleaning device for scrubbing and rinsing bathroom areas and other locations.

BACKGROUND OF THE INVENTION

What is needed is a device that is well-suited for use in cleaning and/or scrubbing the surfaces in showers and shower stalls. However, it should be appreciated that any such cleaning device must be versatile enough such that it can also be used in many other applications, such as cleaning and scrubbing kitchen or laundry areas or other household areas and surfaces or institutional locations, such as restaurants, nursing homes, hospitals, public restrooms, hotels and the like.

A surface, such as a wall of a shower or other portion of a house or structure, is typically cleaned using a sponge, a rag, a cloth, a paper towel or some other cleaning medium. In general, a cleaning solution with or without water is initially applied to the medium, or directly to the is surface, and the cleaning solution is then forcibly rubbed against the surface which is to be cleaned.

In many such situations, soap scum, mildew, mold and stains frequently occur in the area of a surface that cannot be reached using a conventional water source, or as in a shower, by aiming or repositioning the shower head. Additionally many harsh chemical treatments cannot be left on the wall of a shower for more than a few minutes.

While the foregoing cleaning approach may produce a clean surface, it suffers from some drawbacks. That is, this conventional cleaning approach requires frequent interruption for the application of additional cleaning solution or water to the cloth, rag, or towel, thereby undesirably lengthening the overall cleaning process and requiring a relatively large amount of paper towels or cloths to effectively clean a relatively large area since these towels are frequently damaged or destroyed and since the towels must be frequently cleaned. Additionally, the foregoing conventional approach requires the individual to stoop, bend, stretch, or otherwise contort their body in order to fully clean the entire surface or assembly, thereby increasing the likelihood of injury and increasing the amount of effort or work required to effectuate the cleaning. Most significant, however, is the fact that this method requires a user to use a separate means for post-cleaning rinsing of the surface.

Accordingly, it has been considered desirable to develop a new and improved hand-held cleaning and rinsing device which would overcome the foregoing difficulties and others while providing better and more advantageous overall results.

SUMMARY OF THE INVENTION

In view of the above, a preferred embodiment of the present invention provides for a cleaning device having a first end and a second end. The first end provides a coupling for a water input line. The second end has a nozzle for spraying water and a means for attaching a pad assembly, the pad assembly being hingedly movable about the handle portion and having several attachment points for removably attaching cleaning pads.

In another embodiment, the cleaning device provides for a valve, the valve being operable to block the flow of liquid from the first end of the cleaning and rinsing device in its standard position and being operable to permit flow from the first end of the cleaning and rinsing device to the nozzle at the second end of the cleaning and rinsing device. In a particular embodiment, the valve is actuated by a pushbutton.

Another embodiment may provide for a slit-type nozzle producing a broad spray path such that a large surface area can be easily and quickly rinsed.

An embodiment of the cleaning device may have circular protrusions at either side of its second end and a hinged pad assembly, the hinged pad assembly providing a pair of apertures complementary to circular protrusions disposed on the handle of the cleaning device. Yet another preferred embodiment of the pad assembly may provide for a pad support having an aperture defined therewithin and a pad assembly having a plurality of apertures such that, when the hinged pad assembly is held against a surface to be cleaned, the nozzle is directed through the apertures allowing the user to direct water into the pad assembly for wetting or rewetting of the pad.

In yet a further embodiment, the pad assembly is comprised of a pad holder, the pad holder having a plurality of cleaning pad attachment points. A particular embodiment of the pad assembly provides a pad holder that "toes" into a sleeve on the cleaning pad. In yet a further particular embodiment, the cleaning pad is either fabricated from a stiff material or, reinforced by a stiff backing material. In general, a button is disposed on each side of the cleaning pad. Each of the buttons provides for a slot that hooks onto a corresponding edge of the pad holder. When the user of the cleaning device is finished using a cleaning pad, the user can simply depress the buttons on either side of the pad assembly, thereby permitting the pad to drop off.

DETAILED DESCRIPTION

Figure 1:
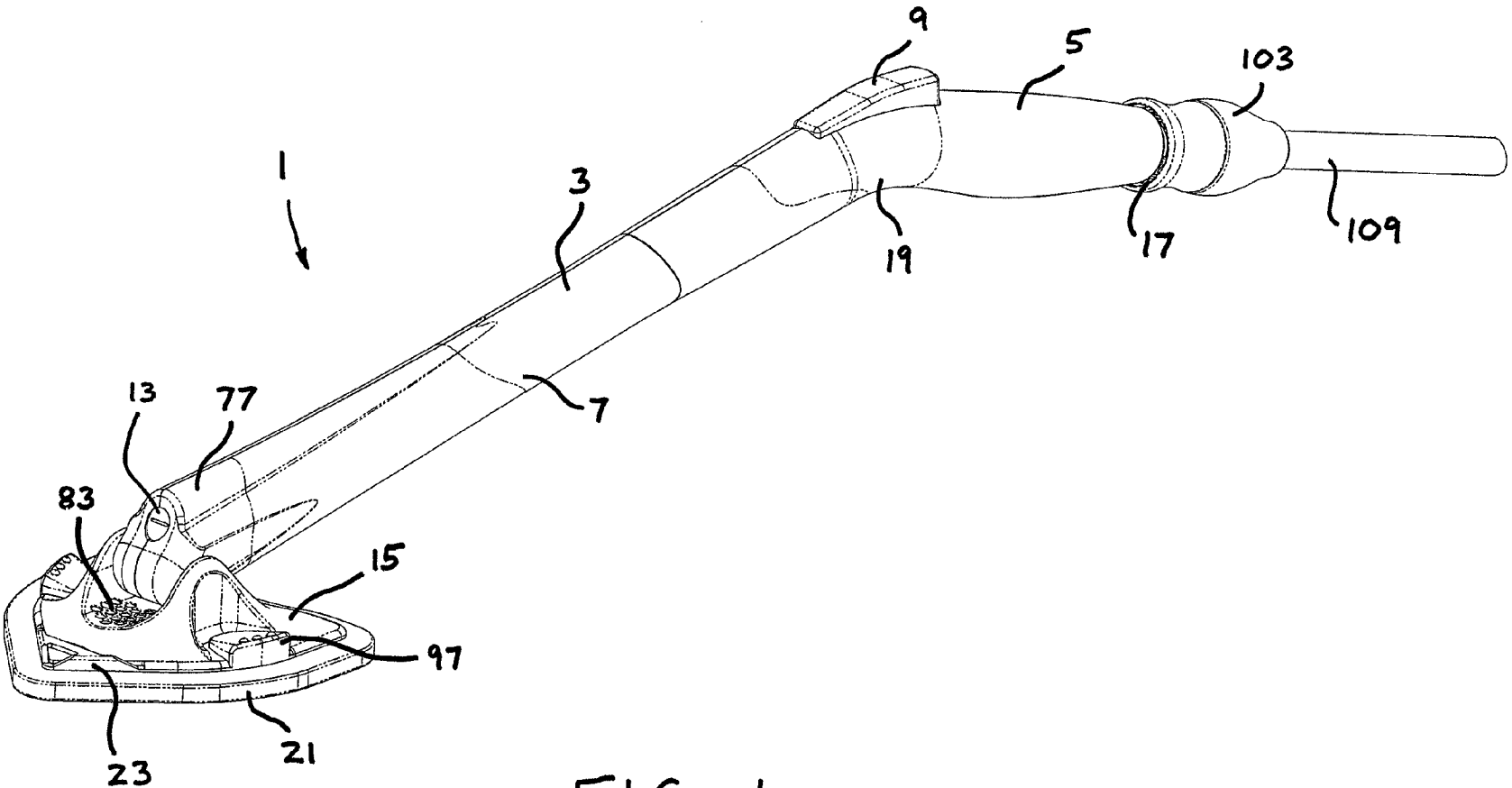
FIG. 1 is a top, front and side perspective view of a preferred embodiment of the cleaning device constructed in accordance with the present invention.
Figure 2:
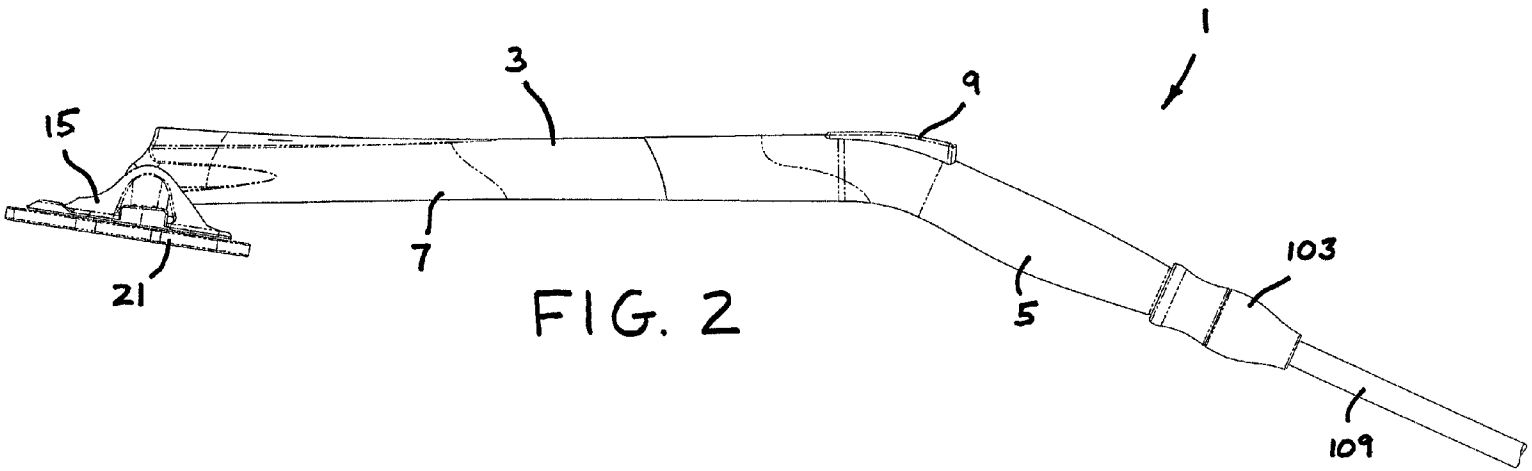
FIG. 2 is a side elevational view of an embodiment of cleaning device of FIG. 1 showing the cleaning pad in the down position.
Figure 11:
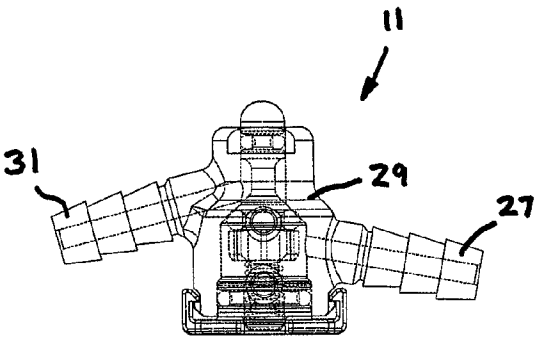
FIG. 11 is an exploded view of one type of valve assembly suitable for use in the cleaning and rinsing device.

Referring now to the drawings in detail, wherein like numbered elements refer to like elements throughout, FIG. 1 illustrates a preferred embodiment of the cleaning and rinsing device 1 of the present invention. As will be discussed in more detail throughout the remainder of the specification, the cleaning and rinsing device 1 is comprised of a handle 3 having a first handle section 5 and a second extension section 7. For manufacturing and packaging purposes, it is preferable to have a two-piece handle, however such is not a limitation of the invention. The handle 3 contains a button 9, the button 9 being operable to depress a valve 11 that controls the flow of water through the handle 3 to a nozzle 13 that is disposed with a nozzle and 77 of the handle 3. See also FIGS. 3, 11 and 12. At the nozzle end 77 are a pair of generally cylindrical fingers 79 that protrude from either side of the extension section 7. See FIG. 3. These fingers 79 provide a mounting point for a pivotable pad holder 15 for use in, for example, washing the walls of a shower. The pad holder 15 is employed to retain a pad backer 23, which in turn provides a mounting point for a cleaning pad 21.

The first handle section 5 of the cleaning and rinsing device 1 has a first water inlet end 17 and a second valve end 19. The handle section 5 contains a central hollow area 25. See Fig. The hollow area 25 provides a conduit for water to flow from the water inlet end 17 to the valve end 19.

Figure 12:
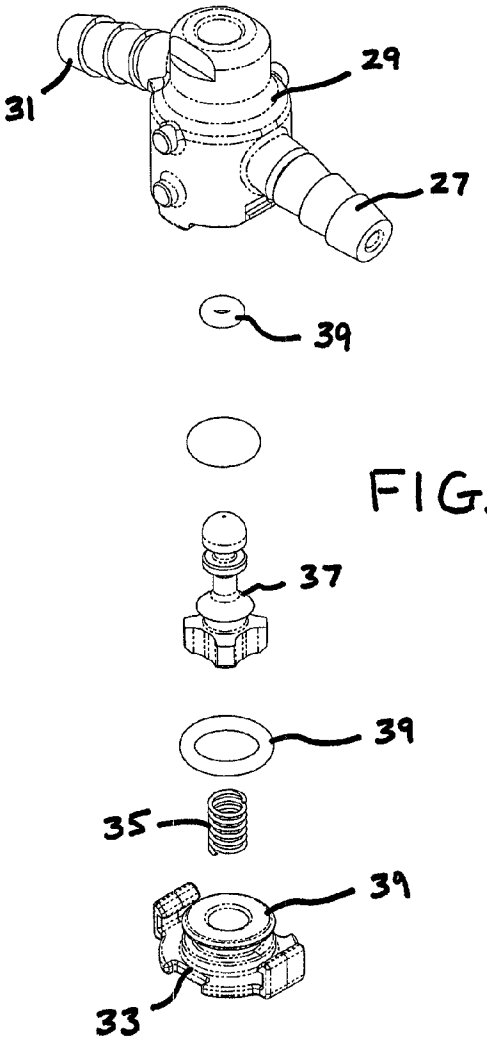
FIG. 12 is a front elevational view of the valve assembly shown in FIG. 11.

Interposed between the extension section 7, (the details of which will be discussed later in this detailed description), and the first handle section 5 is a valve 11. See FIGS. 3, 11 and 12. The valve 11 has an inlet 27, the inlet 27 being located within the hollow area 25 of the first handle section 5. The valve 11 also has an outlet 31 that directs the flow of water into the second extension section 7. The valve assembly 11 has a valve body 29 that can be secured within the handle 3 in any number of ways that are known in the art. As such, the method of securing the valve 11 is not intended to be a limitation of the invention. In greater detail, as shown in FIG. 12, it will be seen that the valve body 29 further contains a valve plug 33 resting on a spring 35 within the valve body 29 and a valve plunger 37. O-rings 39 are employed to create seals between the valve plug 33 and the valve body 29. An additional O-ring 39 is employed in the groove 41 of the valve plunger 37 to seal the valve plunger 37 against the valve body 29.

In operation, the default position of the valve plug 33 is that it always blocks the valve inlet 27, thus preventing the flow of water through the valve body 29. When the valve plunger 37 is manually depressed, which is accomplished when the user depresses the button 9, the valve plug 33 in turn compresses the spring 35 and water can flow through the valve body 29 and out of the valve outlet 31. Again, numerous types of valves may be successfully employed with the cleaning and rinsing device and the foregoing detailed description is not intended to be a limitation of the invention.

Figure 3:
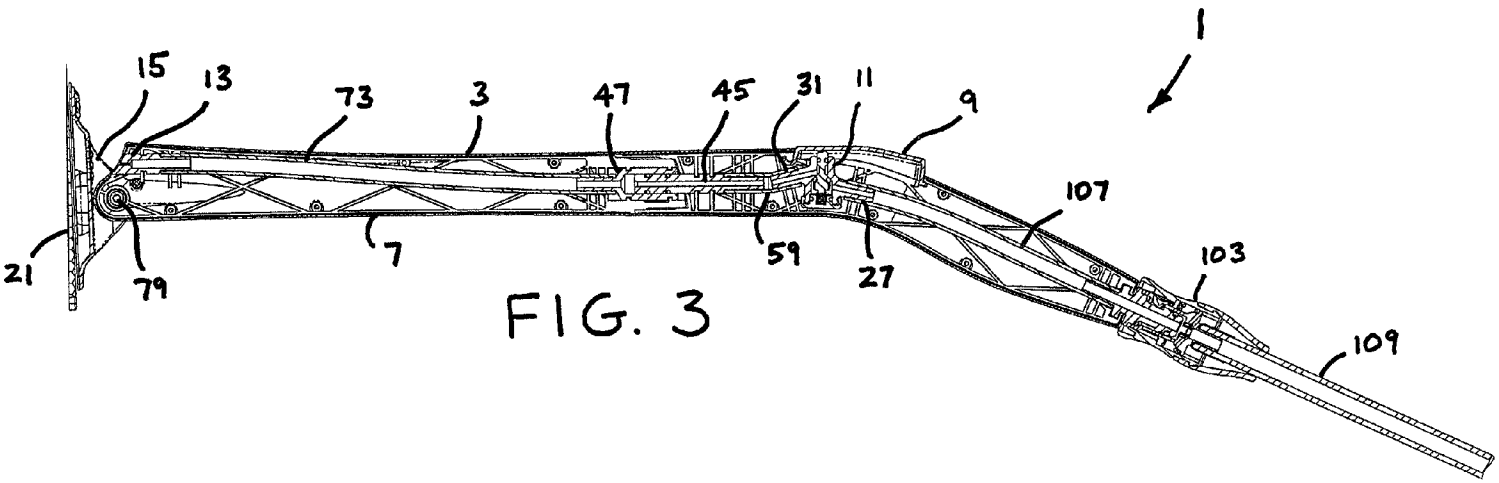
FIG. 3 is a side elevational and cross-sectional view of the embodiment shown in FIG. 2 showing the cleaning pad in position to have fluid sprayed therethrough.
Figure 4:
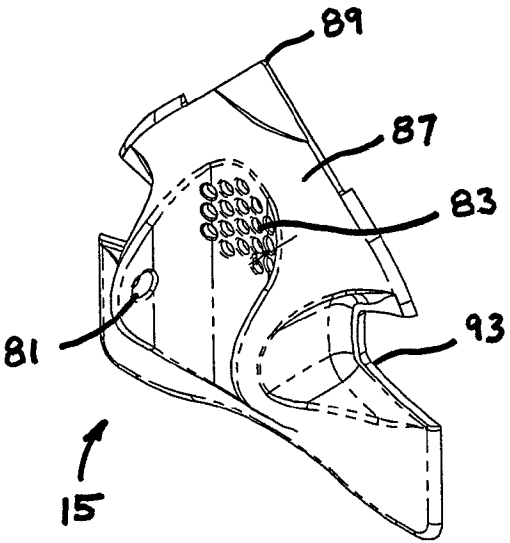
FIG. 4 is a side and top perspective view of the pad holder.
Figure 5:
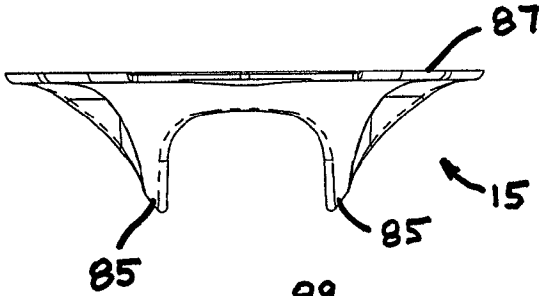
FIG. 5 is a top plan view of the pad holder shown detached from the handle.
Figure 6:
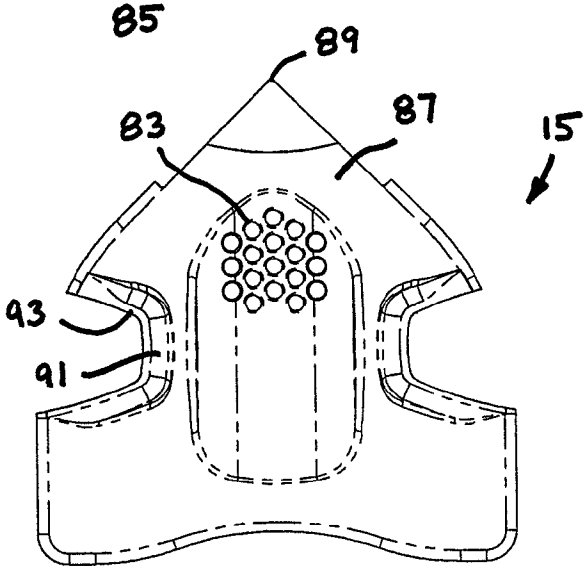
FIG. 6 is a back elevational view of the pad holder.
Figure 7:
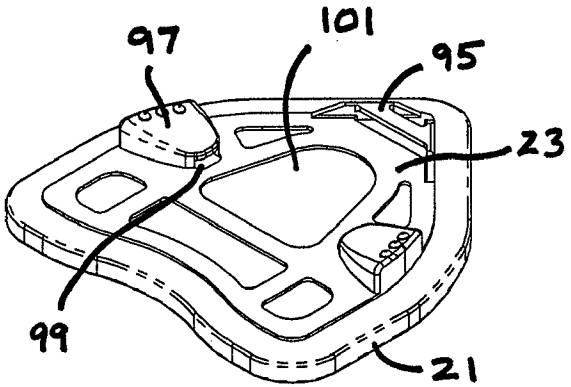
FIG. 7 is a top elevational view of the pad backer and an embodiment of a cleaning pad used with the cleaning and rinsing device.
Figure 10:
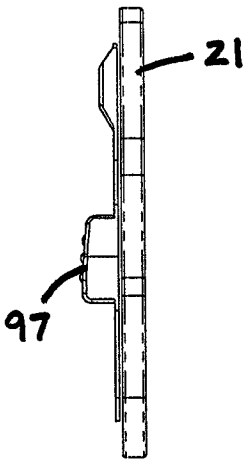
FIG. 10 is a side elevational view of the pad backer and cleaning pad.
Figure 8:
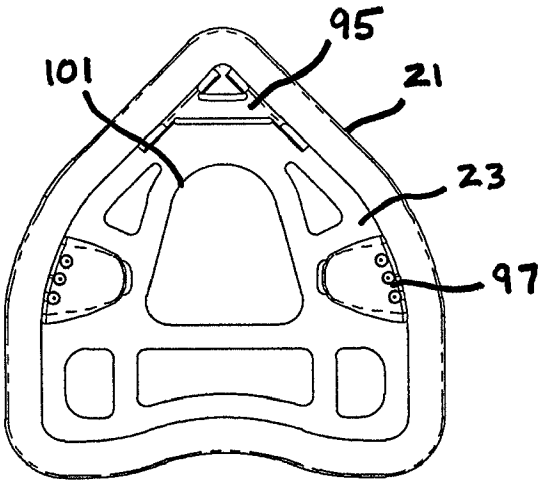
FIG. 8 is a side elevational view of the pad backer and cleaning pad shown in FIG. 7.
Figure 9:
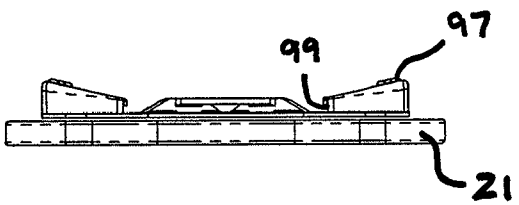
FIG. 9 is a top and side elevational view of the pad backer and cleaning pad shown in FIG. 7.
Figure 14:
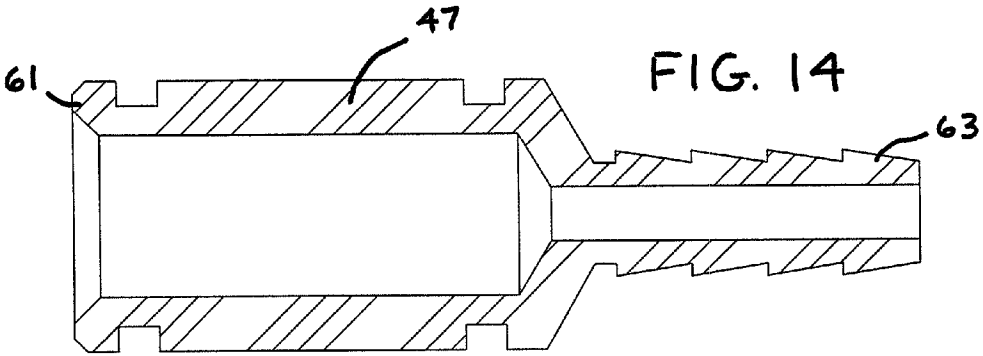
FIG. 14 is a side cross-sectional view of the female coupler of the internal coupling assembly.
Figure 15:
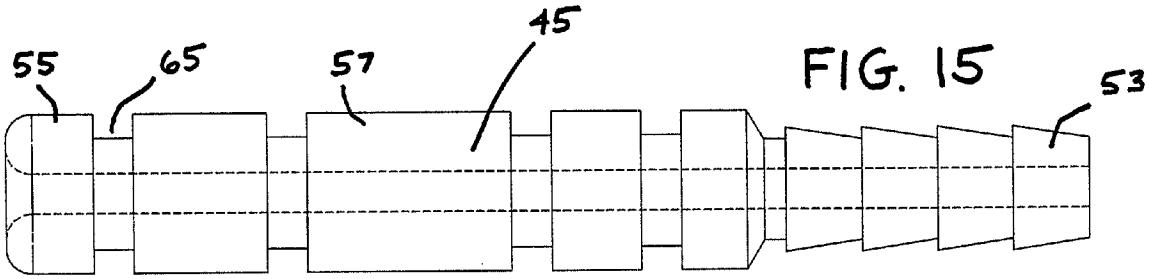
FIG. 15 is a side view of the male coupler of the internal coupling assembly.

The first handle section 5 of the cleaning and rinsing device 1 and the extension section 7 of the cleaning and rinsing device 1 are sealingly joined together. Referring to FIG. 3, it will be seen that the water supply to the nozzle 13 is connected via an internal coupler assembly 43 comprised of a male coupler 45 and a female coupler assembly 47. See also FIGS. 14 and 15. The male coupler 45 has a first inlet end 53, a generally cylindrically shaped exterior 57 and a second end 55. The inlet end 53 of the male coupler 45 is in fluid communication with the valve outlet 31, via a tube 59. The male coupler 45 may have a plurality of circumferential notches 65, in the event gaskets are required to prevent fluid leakage between the male coupler 45 and the female coupler 47.

Figure 16:
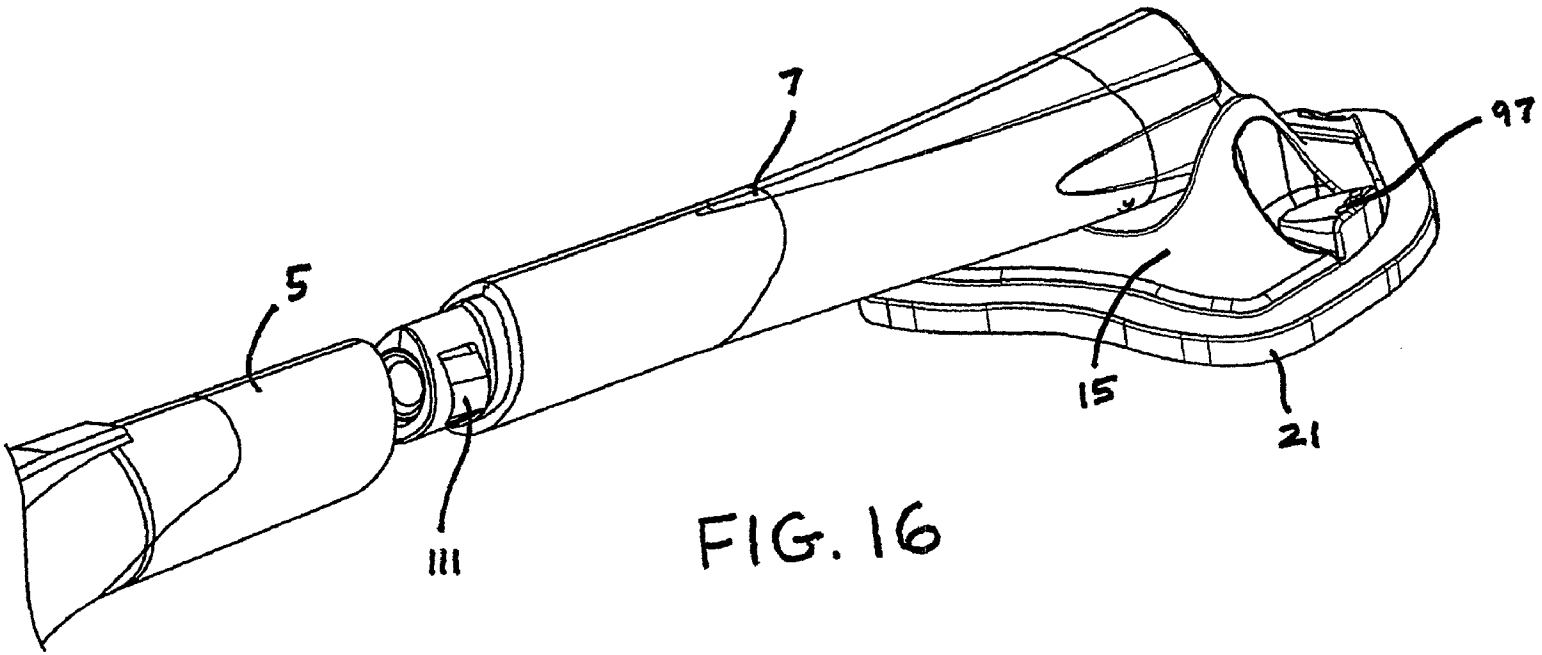
FIG. 16 is a side perspective view of the means for attaching the first handle section and the second handle section together.

The female coupler assembly 47 has a first end 61 having an aperture 63 therethrough, the aperture 63 accommodating the outlet end 55 of the male coupler 45. As shown in FIG. 16 when the first handle section 5 and the second handle section 7 snap together such that a snap retainer 111 on the second handle section 7 secures the first handle section 5 and the second handle section 7 together, the female coupler 47 and the male coupler 45 are held together in fluid communication, that is, the male coupler 45 slides into the first end 61 of the female coupler 45 until the snap retainer 111 secures the first handle section 5 to the second handle section 7. Again, numerous means are available for connecting the first handle section 5 to the second handle section 7 and the foregoing detailed description is not intended to be a limitation of the invention.

Figure 13:
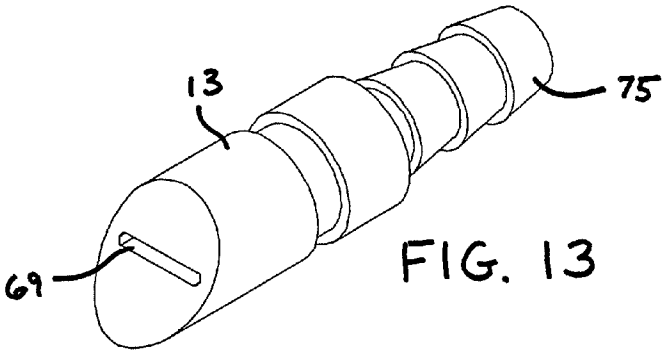
FIG. 13 is a side and top perspective view of one type of nozzle suitable for use in the cleaning and rinsing device.

The outlet end 63 of the female coupler 47 feeds into a tube or hose 73 between the outlet end 63 and the nozzle inlet 75. The nozzle 13 is then anchored or attached into the extension section 7. As the nozzle 13 is primarily used for rinsing and spraying surfaces in relatively close proximity to itself, a water outlet 69 in the shape of a horizontal slit is provided. See FIG. 13. In general, a water outlet 69 that is configured in the shape of a horizontal slit provides for a water spray that is directed over a relatively wide, regular area. The nozzle 13 can be attached to the extension section 7 in any number of ways that are known in the art.

As discussed briefly above, the cylindrical fingers 79 disposed on either side of the nozzle end 77 of the extension section 7 provide a mounting point for a pad holder 15 capable of pivoting for use in washing the walls of a shower, for example. The pad holder 15 is generally comprised of a pair of raised arch sections 85, and a base section 87. The arch sections 85 contain centrally located cavities 81, the cavities 81 accommodating the fingers 79 at the nozzle end 77 of the extension section 7 such that the pad holder 15 is permitted to rotate about the axis created by fingers 79. The range of rotation of the pad holder 15 is limited by interference of the base section 87 with the pad holder 15.

The base 87 of the pad holder 15, in this embodiment, is generally triangle-shaped, although any shape that permits cleaning would be acceptable and the foregoing detailed description is not intended to be a limitation of the invention. However, a triangular shape is preferred for cleaning areas such as the corners of a shower. The base 87 of the pad holder 15 has a narrow triangular tip 89, the purpose of which will be explained later. Additionally, the base 87 of the pad holder 15 has a pair of arched openings 91 on each side of the triangular tip 89 of the pad holder, each of the arched openings 91 having mounting edge 93 the purpose of which will also be explained later in this detailed description.

The cleaning and rinsing device 1 offers disposable cleaning pads 21. The cleaning pads 21 are, in general, attached to a pad backer 23. In one embodiment the cleaning pads 21 are glued to the pad backer 23 and the cleaning pad 21 and pad backer 23 are disposable. The pad backer 23 provides stiffness to the cleaning pad 21 as well as a means for attachment to the pad holder 15. Although other means of attachment are possible, a preferred embodiment of the present invention provides for a triangular sleeve 95 on the pad backer 23, the triangular sleeve 95 being sized slightly larger than the tip 89 of the pad holder 15 such that the pad holder 15 slides, or "toes" into the triangular sleeve 95.

The pad backer 15 also comprises a pair of raised resiliently deformable buttons 97. The buttons 97 are, in general, disposed one on each side of the triangular sleeve 95 and closely match the shape of the arched openings 91 in the base 87 of the pad holder 15. The buttons 97 also contain horizontal slots 99, the slots 99 being the slightly larger than the thickness of the mounting edge 93 of the base 87 of the pad holder 15.

The buttons 97 are resilient so that when a user places the tip 89 of the base 15 in the triangular sleeve 95, the user can push the handle 3 downwardly such that the mounting surface 93 in the arched openings 91 in the base 87 of the pad holder 15 snap into the slots 99 in the buttons 97. Similarly, to release the pad backer 23 and the pad 21, such as when a user has completed a cleaning process, the user need only press the buttons 97 hard enough to overcome the resilience of the buttons 97 thereby pushing the slots 99 off of the mounting surfaces 93 in the pad holder 15.

The pad backer 23 also contains a central aperture 101, the central aperture 101 being generally aligned such that when the handle 3 is pivoted upwardly relative to the pad holder 15, the nozzle 13 is generally aligned with a plurality of apertures 83 in the pad holder 15 and the central aperture 101 such that a user of the cleaning and rinsing device 1 can wet the cleaning pad 21, if desired, before or during use of the cleaning pad 21.

The cleaning and rinsing device 1 has a coupling assembly 103 that directs the flow of water from an external hose 109, to an internal coupling assembly 105, the internal coupling assembly 105 being designed to direct the flow of water via a tube or hose 107 from the internal coupling assembly, via the tube 107 to the valve inlet 27. The type of coupling 103 employed is not essential to any particular embodiment of the cleaning and rinsing device 1. However, a quick-release type coupling 103 may be beneficial for applications such as hotel/motel cleaning in which the housekeeping staff may clean many rooms over the course of a day. A quick-release type coupling 103 may also be beneficial in residential usage to facilitate easy take down and storage of the cleaning and rinsing device 1.

The external hose 109 would normally be connected to the shower head or a diverter slightly upstream from a shower head. The diverter may be one such as is disclosed in U.S. Pat. Nos. 5,560,548 or 5,624,073, which are hereby incorporated by reference in their entirety.

The individual components of cleaning and rinsing device may be fabricated out of any standard material, but are preferably a plastic material for durability and lightweight construction.

Although the invention has been described in considerable detail through the figures and above discussion, many variations and modifications can be made by one skilled in the art without departing from the spirit and scope of the invention as described in the following claims.

What is claimed is:

1. A cleaning device comprising:

a handle comprising a first end, the first end comprising a coupling for a fluid input line, and a second end, the second end comprising a nozzle for spraying fluid out of the nozzle in a spray path that is aligned with the second end of the handle and the second end further comprising a finger to each side of the nozzle, such fingers extending generally perpendicularly to and away from the handle;

a valve disposed within the handle, the valve being operable to block the flow of fluid from the first end of the handle and alternatively to permit flow from the first end of the handle to the nozzle at the second end of the handle;

a pad holder pivotally attached to the second end of the handle, the pad holder comprising a pair of opposing and raised arch sections, each arch section disposed generally perpendicularly relative to the fingers at the second end of the handle and each arch section further having a cavity for receiving one of the fingers at the second end of the handle, and the pad holder further comprising a base section disposed between the arch sections and disposed generally perpendicularly relative to the arch sections, the arch sections and the base section forming a generally U-shaped structure, and the base section further comprising a plurality of apertures defined within it, the pad holder being permitted to pivot about the second end of the handle between a first position where the second end of the handle is substantially perpendicular to the pad holder base section and wherein fluid can be directed through the plurality of apertures in the pad holder and a second position; and a removably attachable pad assembly, the pad assembly comprising a pad backer and a cleaning pad attached to the pad backer, the pad backer comprising at least one attachment point for removably attaching the pad assembly to the pad holder and the pad backer further comprising a central aperture that is generally aligned with the plurality of apertures of the pad holder, the central aperture exposing a portion of the cleaning pad when the pad assembly is attached to the pad holder, and the nozzle and the fluid spray path from the nozzle being generally aligned with the plurality of apertures of the pad holder, the central aperture of the pad backer and the exposed portion of the cleaning pad when the pad holder is in the first position.

2. The cleaning device of claim 1 wherein the valve is actuated by a pushbutton.

3. The cleaning device of claim 1 wherein the nozzle is configured in the shape of a slit.

4. The cleaning device of claim 1 wherein the base section of the pad holder further comprises a triangular tip and wherein the pad assembly further comprises:

a resilient pad backer having a top comprising a triangular envelope accommodating the triangular tip of the base section of the pad holder and a bottom; and the cleaning pad is attached to the bottom of the pad backer.

5. The cleaning device of claim 1 wherein the cleaning pad and the pad backer are disposable.

6. A cleaning and rinsing device comprising:

a handle comprising a first end providing a coupling for a fluid input line and a second end, the second end of the handle having a nozzle for spraying fluid and a pair of generally cylindrical fingers on opposite sides of the nozzle;

a valve disposed within the handle, the valve comprising a valve plug, the valve plug having a default position and the valve being operable to block the flow of fluid from the first end of the handle when the valve plug is in its default position and the valve further being operable to permit flow from the first end of the handle to the nozzle at the second end of the handle;

a pad holder comprising a base section, the base section comprising a triangular tip and a pair of arched openings having pad backer mounting surfaces and the base section further comprising a plurality of apertures defined within it;

the pad holder being permitted to pivot between a first position wherein fluid can be directed through the plurality of apertures in the pad holder and a second position about the cylindrical fingers of the handle;

a resilient pad backer that is removably attachable to the pad holder and comprises a top, the pad backer top comprising a triangular envelope to receive and retain the triangular tip of the base of the pad holder and a bottom; the pad backer further comprising a pair of resilient raised buttons, the buttons having horizontal slots therein and, the slots accommodating the pad backer mounting surfaces when the pad holder is pressed into the pad backer; and the pad backer further comprising a central aperture that is generally aligned with the plurality of apertures of the pad holder; and a cleaning pad attached to the bottom of the pad backer.

7. The cleaning and rinsing device of claim 6 wherein the valve is actuated by a pushbutton.

8. The cleaning and rinsing device of claim 6 wherein the nozzle is configured in the shape of a slit.

9. The cleaning and rinsing device of claim 6 wherein the cleaning pad and cleaning pad backer are disposable.

* * * * *